US008512827B2

(12) United States Patent
Seguchi et al.

(10) Patent No.: US 8,512,827 B2
(45) Date of Patent: Aug. 20, 2013

(54) INK JET RECORDING MEDIUM

(75) Inventors: Kenichi Seguchi, Okaya (JP); Kazuhiko Yamamoto, Chikuhoku-mura (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 13/168,108

(22) Filed: Jun. 24, 2011

(65) Prior Publication Data

US 2011/0318510 A1 Dec. 29, 2011

(30) Foreign Application Priority Data

Jun. 24, 2010 (JP) ..... 2010-143878

(51) Int. Cl.
*B41M 5/00* (2006.01)
*B41M 5/52* (2006.01)
*B41M 5/50* (2006.01)

(52) U.S. Cl.
CPC ..... *B41M 5/52* (2013.01); *B41M 5/5254* (2013.01); *B41M 5/5218* (2013.01); *B41M 5/5236* (2013.01); *B41M 5/508* (2013.01)
USPC ..... 428/32.26; 428/32.31; 428/32.33; 428/32.34; 428/32.38

(58) Field of Classification Search
CPC .... B41M 5/52; B41M 5/5254; B41M 5/5218; B41M 5/5236; B41M 5/508
USPC ..... 428/32.26, 32.31, 32.33, 32.34, 32.38
See application file for complete search history.

(56) References Cited

U.S. PATENT DOCUMENTS

| | | | | |
|---|---|---|---|---|
| 3,562,754 | A | 2/1971 | Placido | |
| 4,880,465 | A | 11/1989 | Loria et al. | |
| 2004/0001135 | A1* | 1/2004 | Soga | 347/106 |
| 2008/0182083 | A1* | 7/2008 | Oyanagi et al. | 428/195.1 |
| 2010/0321454 | A1 | 12/2010 | Seguchi et al. | |

FOREIGN PATENT DOCUMENTS

| | | | |
|---|---|---|---|
| EP | 0698501 | A1 | 2/1996 |
| JP | 07-034227 | A | 2/1995 |
| JP | 3372709 | B2 | 11/2002 |
| JP | 2003-166183 | A | 6/2003 |
| JP | 2004-345110 | A | 12/2004 |
| JP | 2005-74880 | A | 3/2005 |
| JP | 2006-088341 | A | 4/2006 |
| JP | 2009-125958 | A | 6/2009 |
| JP | 2011-5651 | A | 1/2011 |

* cited by examiner

*Primary Examiner* — Betelhem Shewareged
(74) *Attorney, Agent, or Firm* — Nutter McClennen & Fish LLP; John J. Penny, Jr.; Christina M. Sperry

(57) ABSTRACT

Provided is an ink jet recording medium which is capable of reproducing a wide range of gloss including high luster like metallic luster and substantially no luster due to matting by varying only the amount of applied ink and in which the consumption of a white ink used to adjust the glossiness thereof is small.

20 Claims, No Drawings

INK JET RECORDING MEDIUM

BACKGROUND

1. Technical Field

The present invention relates an ink jet recording medium which is used for aqueous pigment inks, which is highly transparent, and which has the ability to express a wide range of gloss and/or whiteness. The ink jet recording media is suitable for, for example, proofing.

2. Related Art

Ink jet recording methods are used to record images in such a manner that fine droplets of inks are ejected by various operating principles so as to be applied to recording media such as paper sheets or films. Images formed by the ink jet recording methods have increased resolution and color reproducibility and therefore, in recent years, have been increasingly demanded for design applications, such as posters, displays, leaflets, and package proofs, needed to have high color developability and reproducibility. For package proofing applications, for example, color samples adjusted in light of gloss properties of package materials are required.

In order to accurately reproduce the difference in gloss between package materials, the ability to reproduce a wide range of gloss including high luster like metallic luster and substantially no luster like a matted material is required.

There has been no ink jet recording medium capable of completely coping with such a requirement. In order to exhibit high gloss, a metal layer is placed on a side of a transparent support and an ink-receiving layer is placed on another side thereof as disclosed in, for example, Japanese Patent No. 3372709 (Patent Document 1). High gloss can be exhibited by this technique; however, it is difficult to reduce gloss by this technique. That is, it is difficult for ink jet recording media including metal layers to express the texture of low-gloss materials such as matted materials.

Therefore, in the case of expressing a matte texture using a film including a metal layer disposed on a surface of a base member of an ink jet recording medium, the base member is made cloudy so as to have reduced gloss in such a manner that a surface of the base member that is opposite to the metal layer is physically matted by sandblasting as disclosed in, for example, JP-A-7-34227 (Patent Document 2). In any way, in order to cope with needs for ink jet recording media having various glossy textures, a plurality of recording media need to be prepared. There has been no ink jet recording medium capable of being adjusted in glossiness by the amount of applied ink.

SUMMARY

An advantage of some aspects of the invention is to provide an ink jet recording medium which can cope with design applications and which has high texture reproducibility, that is, an ink jet recording medium capable of reproducing a wide range of gloss including high luster like metallic luster and low luster due to matting by varying only the amount of applied ink. An advantage of some aspects of the invention is to provide an ink jet recording medium in which the consumption of a white ink used to adjust the glossiness thereof is small. Furthermore, an advantage of some aspects of the invention is to provide an ink jet recording medium which can cope with gloss properties of various types of package materials and which can accurately express a color sample adjusted in light of the texture of a package material.

The inventor has found that when an ink jet recording medium includes the metal layer and an ink-receiving layer having a 60-degree specular glossiness of 750 or more as specified in JIS Z 8741 and a white ink is applied to the ink-receiving layer at 10% duty such that the 60-degree specular glossiness of the ink-receiving layer is 450, human eyes perceive a matte, low-gloss texture. The invention is based on this finding. According to the invention, the textures of materials with metallic luster and those of matted, lusterless materials can be faithfully reproduced by varying only the amount of a white ink applied to an ink jet recording medium including a metal layer and an ink-receiving layer between 0% duty and 10% duty.

Solutions to the above objects are as described below.

An ink jet recording medium according to the invention includes a transparent film; an ink-receiving layer disposed on the transparent film; and a metal layer, disposed on the transparent film, for achieving metallic luster. The ink-receiving layer has a 60-degree specular glossiness of 750 or more as specified in JIS Z 8741. The ink-receiving layer having a white ink applied thereto at 10% has a 60-degree specular glossiness of 450 or less as specified in JIS Z 8741.

As used herein, "% duty" is a value given by the following equation:

$$\%\ \text{duty} = \text{the number of printed dots}/(\text{vertical resolution} \times \text{horizontal resolution}) \times 100$$

wherein "the number of printed dots" is the number of printed dots per unit area and each of "vertical resolution" and "horizontal resolution" is the resolution per unit area. The term "100% duty" refers to the maximum weight of a single color ink per pixel.

Metallic luster and no metallic luster due to matting can be reproduced on one type of recording medium in such a manner that the white ink is applied to the ink jet recording medium within a range from 0% duty up to 10% duty. For example, such gloss that metallic luster is lost and the shape of a light source cannot be recognized at all can be reproduced.

In the ink jet recording medium, the L-value is 50 or more in the case of printing the white ink at 10%.

As used herein, "L-value" is the lightness index L* specified in JIS Z 8729 and can be measured at a viewing angle of 2 degrees using Eye-One available from GretagMacbeth and a D50 light source. An L-value closer to 100 indicates a higher lightness index (white) and an L-value closer to 0 indicates a lower lightness index (black).

Even if the glossiness of the ink jet recording medium is significantly reduced by applying the white ink thereto, the ink jet recording medium has an L-value of 50 or more and therefore can completely reproduce white. Thus, the ink jet recording medium is particularly useful as a proof material used to design a plastic packaging material.

According to the ink jet recording medium, it is not necessary to print a color sample adjusted in light of the influence of various packaging materials on an actual packaging material and a color sample adjusted in light of influences caused by changing a packaging material can be prepared in such a manner that an image is printed on one type of recording medium by an ink jet process.

In the ink jet recording medium, the rate of change in glossiness of the ink-receiving layer is −35% or more in the case of applying the white ink to the ink-receiving layer at 10% on the basis of 0%, the glossiness of the ink-receiving layer being specified in JIS Z 8741.

As used herein, "rate of change in glossiness" is a value given by the following equation:

rate of change in glossiness=(glossiness before printing)/(glossiness after printing with a white ink at 10% duty)×100 wherein "glossiness before printing" refers to the glossiness of a recording medium not printed with the white ink or another ink and "glossiness after printing with a white ink at 10% duty" refers to the glossiness of the recording medium printed with the white ink at 10% duty.

Metallic luster and no metallic luster due to matting can be accurately reproduced on one type of recording medium depending on the amount of the applied white ink in such a manner that the white ink is applied to the ink jet recording medium at a range from 0% duty up to 10% duty by varying the amount of the applied white ink.

In the ink jet recording medium, the rate of change in L-value of the ink-receiving layer is 3 or more or 2.3 or less in the case of applying the white ink to the ink-receiving layer at 10% on the basis of 0%.

As used herein, "rate of change in L-value" is a value given by the following equation:

rate of change in *L*-value=(*L*-value before printing)/(*L*-value after printing with a white ink at 10% duty)×100 wherein "L-value before printing" refers to the L-value of a recording medium not printed with the white ink or another ink and "L-value after printing with a white ink at 10% duty" refers to the L-value of the recording medium printed with the white ink at 10% duty.

When the rate of change in L-value is 3 or more, a wide range of gloss including high luster like metallic luster and low luster due to matting can be reproduced on one type of ink jet recording medium by slightly varying the amount of the applied white ink. When the rate of change in glossiness is 2.3 or less, white can be readily reproduced because the rate of change in L-value is small even if the gloss is significantly reduced by the application of the white ink.

DESCRIPTION OF EXEMPLARY EMBODIMENTS

A transparent film used in the invention is preferably a polyester film, a polyolefin film, a cellulose film, a polyamide film, an aramid film, or the like. In particular, a polyethylene film is preferably used.

A metal layer can be provided on a surface of the transparent film by vapor deposition or by attaching a metal foil to the transparent film.

A metal used is aluminum, tin, zinc, copper, or the like. Aluminum is most preferred to achieve high specular glossiness in consideration of cost.

The metal layer preferably has a thickness of 1 angstrom to 2 μm. When the thickness thereof is less than 1 angstrom, no metallic luster is obtained. When the thickness thereof is more than 2 μm, the effect of an increase in thickness cannot be obtained.

In the invention, in order to increase the adhesion between the transparent film and the metal layer, a primer layer (undercoat) may be provided therebetween as required. The primer layer is formed in such a manner that an organic solvent solution or aqueous solution containing a resin such as an acrylic resin, a nitrocellulose resin, a urethane resin, a melamine resin, or an epoxy resin is uniformly applied to the transparent film by, for example, a common coating process such as a gravure coating process or a spray coating process and is then dried (or cured in the case of using a heat-curable resin, an electron beam-curable resin, or a ultraviolet-curable resin). The thickness of the primer layer is usually within a range from 0.005 μm to 2 μm and preferably 0.01 μm to 1 μm. When the thickness of the primer layer is less than this range, the primer layer hardly contributes to piece dyeing or the adhesion to the metal layer and therefore it is meaningless to provide the primer layer, which is not preferable.

In the invention, an ink-receiving layer is provided on, for example, a surface of the transparent film that is opposite to the metal layer. A dispersing resin such as a urethane resin or an acrylic resin is preferably used to form the ink-receiving layer because the dispersing resin is known to form a layer with good ink absorbability, water resistance, and transparency. Alternatively, a material prepared by crosslinking a dispersing resin such as an acrylic resin with a carbodiimide may be used to form the ink-receiving layer. In particular, a urethane resin is usually used. The ink-receiving layer may be provided on the surface of the transparent film that underlies the metal layer so as to directly overlie the metal layer or so as to overlie the metal layer with another layer disposed therebetween.

The ink-receiving layer may have, for example, a configuration below.

The ink-receiving layer may contain a resin prepared by crosslinking a polyurethane resin having a silanol group with a crosslinking agent selected from polyisocyanate, polyethyleneimine, and a carbodiimide resin as disclosed in JP-A-2003-166183.

In particular, the ink-receiving layer may be one that contains 75% by weight of a polyurethane emulsion, TAKELAC XW-75-X35, having a solid content of 30% by weight, available from Takeda Pharmaceutical Co., Ltd. and 15% by weight of a carbodiimide resin, CARBODILITE V-02, available from Nisshinbo Holdings Inc. as described in Example 5 of JP-A-2003-166183; one that contains an acrylic polymer and a compound having a carbodiimide group as disclosed in JP-A-2004-345110; one that contains a dispersing resin such as polyester urethane latex or acrylic silicone latex and a carbodiimide as disclosed in JP-A-2009-125958; or one that contains a waterborne urethane resin, a waterborne acrylic resin, and a crosslinking agent as disclosed in JP-A-2005-74880.

Furthermore, the following resin is preferred: a material prepared by crosslinking a urethane resin and a dispersing resin such as a combination of a cationic acrylic silicone emulsion resin having a hydrolyzable silyl group and a cationic urethane resin as disclosed in JP-A-2006-88341.

Examples of a urethane resin used herein include polyester urethane resins and polyether urethane resins. In particular, a cationic polyether urethane resin is preferred.

Examples of the cationic urethane resin include cationic polyester urethane resins and cationic polyether urethane resins. In particular, a cationic polyether urethane resin is preferred.

Examples of an acrylic resin used herein include acrylic polymers such as polymers of acrylic esters, polymers of methacrylic esters, and copolymers of acrylic esters and methacrylic esters; ethylene-vinyl acetate copolymers such as ethylene-vinyl acetate, ethylene-acrylate-vinyl acetate, and ethylene-vinyl chloride-vinyl acetate; and acrylate-styrene copolymers. In particular, a cationic acrylate-styrene copolymer is preferred.

The ink-receiving layer preferably contains 5% to 25% by weight of the cationic acrylic silicone emulsion resin and 75% to 95% by weight of the cationic urethane resin on a solid basis.

Furthermore, the content of the cationic acrylic silicone emulsion resin therein is preferably 10% to 20% and the content of the cationic urethane resin therein is preferably 80% to 90%.

A crosslinking agent used herein is one selected from a polyisocyanate, a polyethyleneimine, and a carbodiimide resin.

The carbodiimide resin is a water-soluble or water-dispersible carbodiimide compound which is obtained in such a manner that terminal isocyanate groups of a condensation product obtained by the decarboxycondensation of diisocyanates or a diisocyanate and a triisocyanate are sealed with hydrophilic groups.

The diisocyanate and the triisocyanate may be any of alicyclic isocyanates, aliphatic isocyanates, and aromatic isocyanates and are preferably those having at least two or more isocyanate groups, particularly those having two isocyanate groups. Examples of such isocyanates include isocyanates, such as 4,4'-dicyclohexylmethane diisocyanate (HMDI), tetramethylxylylene diisocyanate (TMXDI), isophorone diisocyanate (IPDI), 2,4,6-triisopropylphenyl diisocyanate (TIDI), 4,4'-diphenylmethane diisocyanate (MDI), tolylene diisocyanate (TDI), and hydrogenated tolylene diisocyanate (HTDI), having no isocyanate group bonded to a carbon atom of a methylene group and also include alicyclic, aliphatic, and aromatic isocyanates, such as hexamethylene diisocyanate (HDI), hydrogenated xylylene diisocyanate (H6XDI), xylylene diisocyanate (XDI), 2,2,4-trimethylhexamethylene diisocyanate (TMHDI), 1,12-dodecane diisocyanate (DDI), norbornene diisocyanate (NBDI), and 2,4-bis-(8-isocyanate octyl)-1,3-dioctylcyclobutane (OCDI), having two or more isocyanate groups bonded to carbon atoms of methylene groups.

A compound used to seal the terminal isocyanate groups is a water-soluble or water-dispersible organic compound having groups reactable with isocyanate groups. Examples of such a compound include monoalkyl esters and monoalkyl ethers of bifunctional water-soluble organic compounds such as polyethylene glycol and polypropylene glycol and monofunctional organic compounds having a cationic group such as a nitrogen-containing group or an anionic group such as a sulfonyl group. In particular, polyethylene glycol monomethyl ether and polypropylene glycol monomethyl ether are preferred.

A white ink composition used herein refers to an ink composition satisfying the following inequalities in the case of measuring the lightness (L*) and chromaticity (a* and b*) of a print with a colorimeter, GretagMacbeth Spectrolino, available from X-Rite Inc., the print being prepared by applying a sufficient amount of the ink composition to a sheet of genuine Epson photo paper "Gloss" available from Seiko Epson Corporation such that the sheet is covered with the ink composition:

$$70 \leqq L^* \leqq 100,$$

$$-3.5 \leqq a^* \leqq 1, \text{ and}$$

$$-5 \leqq b^* \leqq 1.5.$$

The white ink composition is used to reduce the gloss of an ink jet recording medium according to the invention. The white ink composition is not particularly limited and may contain a white colorant. The white colorant preferably contains a metal compound or hollow resin particles.

The white ink composition preferably contains at least one of the metal compound and the hollow resin particles. In order to allow the white ink composition to have increased fixation to the ink jet recording medium, the white ink composition preferably further contains a fixative resin.

The metal compound is a metal oxide, barium sulfate, or calcium carbonate, which is conventionally used as a white pigment. Examples of the metal compound include, but are not limited to, titanium dioxide, zinc oxide, silica, alumina, and magnesium oxide. In the invention, the metal compound is preferably titanium dioxide or alumina.

The content of the metal compound in the white ink composition is preferably 1% to 20% by mass and more preferably 5% to 15% by mass. When the content of the metal compound is more than 20% by mass, ink jet recording heads are likely to be clogged, leading to a reduction in reliability. However, when the content of the metal compound is less than 1% by mass, the whiteness and/or color density of the white ink composition is likely to be insufficient.

The metal compound preferably has an average particle size (outer diameter) of 30 nm to 600 nm and more preferably 200 nm to 400 nm. When the average particle size thereof is more than 600 nm, the precipitation of particles may impair the diffusion stability and ink jet recording heads are likely to be clogged, leading to a reduction in reliability. However, when the average particle size thereof is less than 30 nm, the whiteness is likely to be insufficient.

The average particle size of the metal compound can be measured with a laser diffraction-scattering particle size distribution analyzer. An example of the laser diffraction-scattering particle size distribution analyzer is a dynamic light scattering particle size distribution analyzer, Microtrack UPA, available from Nikkiso Co., Ltd.

In the invention, the hollow resin particles preferably have internal cavities and shells made of a liquid-permeable resin. This allows the internal cavities to be filled with an aqueous medium when the hollow resin particles are present in an aqueous ink composition. The hollow resin particles filled with the aqueous medium have substantially the same density as that of the aqueous medium and therefore do not settle in the aqueous ink composition; hence, the diffusion stability thereof can be maintained. This allows the ink composition to have increased storage stability and ejection stability.

After the white ink composition containing the hollow resin particles is applied to a recording medium such as paper, the hollow resin particles is dried and therefore the aqueous medium is removed from the internal cavities. The dry hollow resin particles contain air and therefore form resin and air layers having different refractive indexes. The resin and air layers effectively scatter incident light and therefore can exhibit white.

The hollow resin particles used herein are not particularly limited and may be those well known. The hollow resin particles are preferably those disclosed in, for example, U.S. Pat. Nos. 4,880,465 or 3,562,754.

The hollow resin particles preferably have an average size (outer diameter) of 0.2 μm to 1.0 μm and more preferably 0.4 μm to 0.8 μm. When the outer diameter thereof is more than 1.0 μm, the hollow resin particles are likely to be settled to cause a reduction in diffusion stability or are likely to cause the clogging of ink jet recording heads, leading a reduction in reliability. However, when the outer diameter thereof is less than 0.2 μm, color density such as whiteness is likely to be insufficient. The hollow resin particles preferably have an inner diameter of about 0.1 μm to 0.8 μm.

The average size of the hollow resin particles can be measured with a laser diffraction-scattering particle size distribution analyzer. An example of the laser diffraction-scattering particle size distribution analyzer is a dynamic light scattering particle size distribution analyzer, Microtrack UPA, available from Nikkiso Co., Ltd.

The content (solid content) of the hollow resin particles in the white ink composition is preferably 5% to 20% by mass and more preferably 8% to 15% by mass. When the content (solid content) of the hollow resin particles is more than 20% by mass, ink jet recording heads are likely to be clogged, leading a reduction in reliability. However, when the content thereof is less than 5% by mass, the whiteness is likely to be insufficient.

A method for preparing the hollow resin particles is not particularly limited. The hollow resin particles can be prepared by a known method. For example, the following method can be used to prepare the hollow resin particles: an emulsion polymerization method in which a hollow resin particle emulsion is formed in such a manner that a vinyl monomer, a surfactant, a polymerization initiator, and an aqueous dispersion medium are mixed together in a nitrogen atmosphere while being heated.

The vinyl monomer may be a nonionic monoethylenic unsaturated monomer. Examples of the nonionic monoethylenic unsaturated monomer include styrene, vinyl toluene, ethylene, vinyl acetate, vinyl chloride, vinylidene chloride, acrylonitrile, (meth)acrylic amide, and (meth)acrylic esters. Examples of the (meth)acrylic esters include methyl acrylate, methyl methacrylate, ethyl (meth)acrylate, butyl (meth)acrylate, 2-hydroxyethyl methacrylate, 2-ethylhexyl (meth)acrylate, benzyl (meth)acrylate, lauryl (meth)acrylate, oleyl (meth)acrylate, palmityl (meth)acrylate, and stearyl (meth) acrylate.

Alternatively, the vinyl monomer may be a bifunctional vinyl monomer. Examples of the bifunctional vinyl monomer include divinyl benzene, allyl methacrylate, ethylene glycol dimethacrylate, 1,3-butanediol dimethacrylate, diethylene glycol dimethacrylate, and trimethylolpropane methacrylate. The hollow resin particles can be prepared by highly crosslinking a copolymer obtained by copolymerizing the nonionic monoethylenic unsaturated monomer and the bifunctional vinyl monomer so as to have light scattering properties, heat resistance, solvent resistance, and solvent dispersibility, and the like.

The surfactant may be one that forms molecular clusters such as micelles in water. Examples of the surfactant include anionic surfactants, nonionic surfactants, cationic surfactants, and amphoteric surfactants.

The polymerization initiator may be a known water-soluble compound. Examples of the polymerization initiator include hydrogen peroxide and potassium persulfate.

Examples of the aqueous medium include water and a mixture of a hydrophilic organic solvent and water.

The white ink composition preferably contains the fixative resin such that the metal compound or the hollow resin particles are fixed. Examples of the fixative resin include an acrylic resin such as ALMATEX available from Mitsui Chemicals, Inc. and a urethane resin such as WBR-022U available from Taisei Fine Chemical Co., Ltd.

The content of the fixative resin in the white ink composition is preferably 0.5% to 10% by mass and more preferably 0.5% to 3% by mass.

The white ink composition preferably further contains at least one of an alkane diol and a glycol ether. The alkane diol and the glycol ether allow the white ink composition to have increased wettability to recording surfaces of recording media and increased permeability.

Preferred examples of the alkane diol include 1,2-alkane diols, such as 1,2-butane diol, 1,2-pentane diol, 1,2-hexane diol, 1,2-heptane diol, and 1,2-octane diol, having four to eight carbon atoms. In particular, 1,2-hexane diol, 1,2-heptane diol, and 1,2-octane diol, which have six to eight carbon atoms, are preferred because these diols have particularly high permeability to recording media.

Examples of the glycol ether include polyalcohol lower-alkyl ethers such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, dipropylene glycol monomethyl ether, dipropylene glycol monoethyl ether, triethylene glycol monomethyl ether, triethylene glycol monobutyl ether, and tripropylene glycol monomethyl ether. In particular, triethylene glycol monobutyl ether is useful in achieving good recording quality.

The content of at least one of the alkane diol and the glycol ether in the white ink composition is preferably 1% to 20% by mass and more preferably 1% to 10% by mass.

The white ink composition preferably further contains an acetylene glycol surfactant or a polysiloxane surfactant. The acetylene glycol surfactant and the polysiloxane surfactant allow the white ink composition to have increased wettability to recording surfaces of recording media and increased permeability.

Examples of the acetylene glycol surfactant include 2,4,7,9-tetramethyl-5-decyne-4,7-diol, 3,6-dimethyl-4-octyne-3,6-diol, 3,5-dimethyl-1-hexyne-3-ol, and 2-4-dimethyl-5-hexyne-3-ol. The acetylene glycol surfactant may be a commercially available product. Examples of the commercially available product include surfactants, Olfine STG, Olfine E1010, and Olfine Y available from Nissin Chemical Industry Co., Ltd. and surfactants, Surfynol 104, Surfynol 82, Surfynol 465, Surfynol 485, and Surfynol TG, available from Air Products and Chemicals, Inc.

The polysiloxane surfactant may be a commercially available product. Examples of this commercially available product include surfactants, BYK-347 and BYK-348, available from Byk Chemie Japan K. K.

The white ink composition may further contain an additional surfactant such as an anionic surfactant, a nonionic surfactant, or an amphoteric surfactant.

The content of the additional surfactant in the white ink composition is preferably 0.01% to 5% by mass and more preferably 0.1% to 0.5% by mass.

The white ink composition preferably further contains a ternary amine. The ternary amine functions as a pH adjuster and can readily adjust the pH of the white ink composition.

The ternary amine is, for example, triethanolamine.

The content of the ternary amine in the white ink composition is preferably 0.01% to 10% by mass and more preferably 0.1% to 2% by mass.

The white ink composition preferably further contains water, which functions as a common solvent. The water contained therein is preferably ultra-pure water or pure water such as ion-exchanged water, ultrafiltered water, reverse osmosis water, or distilled water. In particular, water sterilized by ultraviolet irradiation, the addition of hydrogen peroxide, or another technique is preferred because the growth of molds or bacteria can be prevented over a long period of time.

The white ink composition may further contain at least one of additives such as fixatives including water-soluble rosins, antiseptic and fungicidal agents including sodium benzoate, anti-oxidation and ultraviolet-absorbing agents including allophanates, chelating agents, and oxygen absorbers as required. These additives may be used alone or in combination.

As well as conventional pigment inks, the white ink composition can be prepared using a known apparatus such as a ball mill, a sand mill, an attritor, a basket mill, or a roll mill. Coarse particles are preferably removed with a membrane filter, a mesh filter, or the like in advance of preparation.

EXAMPLES

1. Preparation of Ink Jet Recording Medium 1

An aluminum layer with a thickness of about 500 angstroms was formed on one surface of a polyethylene terephthalate film with a thickness of about 100 μm in a vacuum by vapor deposition as disclosed in JP-T-9-511955. In order to form an ink-receiving layer, the following composition was applied to the other surface of the polyethylene terephthalate film: Ink-receiving Layer-forming Composition 1 containing, on a dry basis, 15 parts by weight of a cationic acrylic silicone resin, AQUABRID 908, having a solid content of 23%, available from Daicel Chemical Industries Ltd.; 78 parts by weight of a polyether urethane resin, SUPERFLEX 600, having a solid content of 25%, available from Dai-ichi Kogyo Seiyaku Co., Ltd.; and seven parts by weight of a carbodiimide, CARBODILITE V02-L2, available from Nisshinbo Holdings Inc.

In particular, the above components were provided in ion-exchanged water in series and were then mixed. The ink-receiving layer was formed so as to have a thickness of 20 μm in a dry state, whereby Ink Jet Recording Medium 1 was obtained.

2. Preparation of Ink Jet Recording Medium 2

Ink Jet Recording Medium 2 was prepared in substantially the same manner as that used to prepare Ink Jet Recording Medium 1 except that a ink-receiving layer with a thickness of 16 μm was formed and the following composition was used instead of Ink-receiving Layer-forming Composition 1: Ink-receiving Layer-forming Composition 2 containing, on a dry basis, 72 parts by weight of a polyether urethane resin, SUPERFLEX 600, having a solid content of 25%, available from Dai-ichi Kogyo Seiyaku Co., Ltd.; 24 parts by weight of an acrylate-styrene copolymer, Rikabond FK-820, having a solid content of 39%, available from CSC Co., Ltd.; 0.5 parts by weight of a water-soluble polymer, containing an oxazoline group, having a solid content of 40%; and 3.5 parts by weight of an acrylic water-soluble self-emulsified epoxy curing agent, prepared by neutralizing a polymer produced by graft-polymerizing a methacrylic acid-butyl acrylate-methyl methacrylate-styrene copolymer and polyethyleneimine with hydrogen chloride, having a solid content of 49%.

3. Preparation of Ink Jet Recording Medium 3

Ink Jet Recording Medium 3 was prepared in substantially the same manner as that used to prepare Ink Jet Recording Medium 1 except that an aluminum layer with a thickness of about 300 angstroms was formed.

4. Preparation of White Ink Composition 1

White Ink Composition 1 (Ink 1) containing the following components was prepared: 10% by mass of a white colorant, 1% by mass of a fixative resin, 10% by mass of a permeable organic solvent, 3% by mass of 1,2-hexane diol, 0.5% by mass of an aqueous solvent, and 0.5% by mass of a surfactant, the remainder being ion-exchanged water. The white colorant contained hollow resin particles, "SX8782(D)" or "SX866(B)", available from JSR Corporation. The fixative resin was a urethane resin, WBR-022U™, having a solid content of 30% by mass, available from Taisei Fine Chemical Co., Ltd. The permeable organic solvent was glycerin. The aqueous solvent was triethanolamine. The surfactant was a polysiloxane surfactant, BYK-348™, available from Byk Chemie Japan K. K.

The hollow resin particles "SX8782(D)" had an outer diameter of 1.0 μm, an inner diameter of 0.8 μm, and a solid content of 28% and were of a water-dispersible type. The hollow resin particles "SX866(B)" had an outer diameter of 0.3 μm, an inner diameter of 0.2 μm, and a solid content of 20% and were of a water-dispersible type.

5. Print Evaluation Test

An ink jet printer, PX-A650, available from Seiko Epson Corporation was used for evaluation. A black ink cartridge was filled with White Ink Composition 1 (Ink 1) and was then used in such a manner that the black ink cartridge was attached to a portion of the ink jet printer.

A solid pattern was printed over each of Ink Jet Recording Media 1 and 2 prepared as described above at 1% to 10% duty using White Ink Composition 1.

In comparative examples, a solid pattern was printed over each of the following recording media instead of Ink Jet Recording Medium 1 in the same manner as the above: a Folex™ display film (abbreviated "folex"), metallic silver, available from Folex Co., Ltd.; a silver label G (abbreviated "Too") available from Too Corporation; and a high metal paper (abbreviated "HMP") available from Tochiman Technical Paper Co., Ltd.

The obtained prints were measured for 60-degree specular glossiness in accordance with JIS Z 8741. Unprinted recording media were also measured for 60-degree specular glossiness. The L-value specified in JIS Z 8729 was measured at a viewing angle of 2 degrees using Eye-One available from GretagMacbeth and a D50 light source.

The evaluation results are shown in Table 1.

TABLE 1

| Duty % | | 0 | 1 | 2 | 3 | 4 | 5 | 6 | 7 | 8 | 9 | 10 | |
|---|---|---|---|---|---|---|---|---|---|---|---|---|---|
| Example 1 Ink Jet Recording Medium 1 | 60-degree specular glossiness | 810 | 760 | 720 | 670 | 620 | 570 | 530 | 490 | 460 | 420 | 400 | Reduced gloss due to matte metallic luster can be expressed by the control of the amount of the white ink composition ejected from the ink head. |
| | L-value | 33 | 38 | 40 | 42 | 43 | 45 | 47 | 50 | 52 | 53 | 54 | |
| Example 2 Ink Jet Recording Medium 2 | 60-degree specular glossiness | 760 | 720 | 680 | 640 | 600 | 560 | 520 | 480 | 450 | 410 | 390 | There is no practical problem although the brilliance of metallic luster is slightly insufficient. |
| | L-value | 26 | 35 | 37 | 39 | 40 | 42 | 45 | 48 | 50 | 51 | 52 | |
| Example 3 Ink Jet Recording Medium 3 | 60-degree specular glossiness | 770 | 720 | 670 | 600 | 560 | 490 | 460 | 420 | 400 | 370 | 350 | There is no practical problem although the brilliance of metallic luster is slightly insufficient. |
| | L-value | 13 | 22 | 26 | 31 | 35 | 39 | 40 | 44 | 47 | 50 | 52 | |
| Comparative | 60-degree | 700 | 670 | 630 | 590 | 570 | 520 | 520 | 480 | 460 | 420 | 390 | The brilliance of metallic luster is clearly |

TABLE 1-continued

| Duty % | | 0 | 1 | 2 | 3 | 4 | 5 | 6 | 7 | 8 | 9 | 10 | |
|---|---|---|---|---|---|---|---|---|---|---|---|---|---|
| Example 1 Trade name: Folex | specular glossiness | | | | | | | | | | | | insufficient and the texture cannot be completely expressed. |
| | L-value | 16 | 22 | 25 | 28 | 31 | 35 | 36 | 37 | 39 | 42 | 45 | |
| Comparative Example 2 Trade name: Too | 60-degree specular glossiness | 810 | 790 | 760 | 730 | 700 | 670 | 650 | 640 | 610 | 580 | 540 | The expression of metallic luster is sufficient; however, brilliance remains even at 10% duty and the expression of matte texture is insufficient. |
| | L-value | 6 | 18 | 22 | 26 | 28 | 32 | 33 | 35 | 37 | 39 | 40 | |
| Comparative Example 3 Trade name: HMP | 60-degree specular glossiness | 740 | 710 | 680 | 640 | 620 | 580 | 560 | 530 | 520 | 500 | 480 | The expression of metallic luster is sufficient; however, brilliance remains even at 10% duty and the expression of matte texture is insufficient. |

As is clear from Table 1, the ink-receiving layers of the prints of the examples have a 60-degree specular glossiness of 750 or more as specified in JIS Z 8741 and can completely express the texture of metallic luster. The ink-receiving layers having the white ink applied thereto at 10% duty have a 60-degree specular glossiness of 450 or less and can completely express matte texture with low luster.

Comparative Example 1 is good in reproducing matte texture and is poor in reproducing metallic luster. Comparative Example 2 can express metallic luster and is poor in reproducing matte texture. Metallic luster and matte lusterless texture cannot be expressed with one recording medium by controlling the amount of applied ink.

In order to evaluate absorbability (the aggregation of pigment ink and the presence of cracks), a solid pattern was printed on each of the recording media of Examples 1 to 3 and Comparative Examples 1 to 3 using the white ink and a printer, "PX-W8000", available from Seiko Epson Corporation. In particular, the solid pattern was printed such that the print resolution was 1,440 dpi×720 dpi and the number of dots per unit square inch was 1,036,800 (100% duty). The obtained prints were left in a 23° C. atmosphere with a relative humidity of 50% for 24 hours and were then evaluated for absorbability. The absorbability was evaluated in such a manner that the surface condition of the resulting prints was checked for at least one of the aggregation of pigment ink and the presence of cracks. Evaluation standards were as described below.

1: no problem or slight aggregation

2: slightly serious aggregation

3: serious aggregation

The overall rating is on a scale of 1 to 5: 1 represents the most practically sufficient performance and larger numbers represent less performance in ascending order.

The evaluation results and the overall rating are shown in Table 2.

TABLE 2

| Duty % | | Rate of change | Absorb-ability | Over-all rating |
|---|---|---|---|---|
| Example 1 Ink Jet Recording Medium 1 | 60-degree specular glossiness | −42 | 1 | 1 |
| | L-value | 2 | | |
| Example 2 Ink Jet Recording Medium 2 | 60-degree specular glossiness | −38 | 1 | 2 |
| | L-value | 2.3 | | |
| Example 3 Ink Jet Recording Medium 3 | 60-degree specular glossiness | −43 | 1 | 3 |
| | L-value | −26 | | |
| Comparative Example 1 Trade name: Folex | 60-degree specular glossiness | −30 | 3 | 5 |

TABLE 2-continued

| Duty % | | Rate of change | Absorb-ability | Over-all rating |
|---|---|---|---|---|
| | L-value | 2.6 | | |
| Comparative Example 2 Trade name: Too | 60-degree specular glossiness | −26 | 3 | 4 |
| | L-value | 2.9 | | |
| Comparative Example 3 Trade name: HMP | 60-degree specular glossiness | −26 | 3 | 4 |

As is clear from Table 2, Examples 1 to 3 exhibit high absorbability; however, Comparative Examples 1 to 3 cannot exhibit sufficient absorbability.

What is claimed is:

1. An ink jet recording medium comprising:

a transparent film;

an ink-receiving layer disposed on the transparent film; and a metal layer, disposed on the transparent film, for achieving metallic luster, wherein the ink-receiving layer has a 60-degree specular glossiness of 750 or more as specified in JIS Z 8741 and the ink-receiving layer having a white ink applied thereto at 10% has a 60-degree specular glossiness of 450 or less as specified in JIS Z 8741.

2. The ink jet recording medium according to claim 1, wherein the L-value is 50 or more in the case of printing the white ink at 10%.

3. The ink jet recording medium according to claim 1, wherein the ink-receiving layer is formed by applying a liquid containing a dispersing resin to the transparent film.

4. The ink jet recording medium according to claim 3, wherein the liquid contains a crosslinkable resin.

5. The ink jet recording medium according to claim 1, wherein the white ink contains a colorant containing at least one selected from hollow resin particles and a metal compound.

6. The ink jet recording medium according to claim 5, wherein the white ink contains a fixative resin and the fixative resin is dispersed in a solvent in the form of particles.

7. The ink jet recording medium according to claim 5, wherein the white ink contains a fixative resin and the content of the fixative resin in the white ink is 0.5% to 10% by mass.

8. The ink jet recording medium according to claim 5, wherein the content of the colorant in the white ink is 5% to 20% by mass.

9. The ink jet recording medium according to claim 5, wherein when the colorant contains the hollow resin particles, the hollow resin particles have an average size of 0.2 μm to 1.0 μm.

10. The ink jet recording medium according to claim 5, wherein when the colorant contains the metal compound, the metal compound has an average particle size of 30 nm to 600 nm.

11. An ink jet recording method, comprising;

controlling an amount of a white ink applied to the ink jet recording medium according to claim 1 to express desired luster.

12. An ink jet recording method, comprising;

controlling an amount of a white ink applied to the ink jet recording medium according to claim 2 to express desired luster.

13. An ink jet recording method, comprising;

controlling an amount of a white ink applied to the ink jet recording medium according to claim 3 to express desired luster.

14. An ink jet recording method comprising;

controlling an amount of a white ink applied to the ink jet recording medium according to claim 5 to express desired luster.

15. The ink jet recording medium according to claim 1, wherein the rate of change in glossiness of the ink-receiving layer is −35% or more in the case of applying the white ink to the ink-receiving layer at 10% on the basis of 0%, the glossiness of the ink-receiving layer being specified in JIS Z 8741.

16. The ink jet recording medium according to claim 15, wherein the rate of change in L-value of the ink-receiving layer is 3 or more in the case of applying the white ink to the ink-receiving layer at 10% on the basis of 0%.

17. The ink jet recording medium according to claim 15, wherein the rate of change in L-value of the ink-receiving layer is 2.3 or less in the case of applying the white ink to the ink-receiving layer at 10% on the basis of 0%.

18. An ink jet recording method, comprising;

controlling an amount of a white ink applied to the ink jet recording medium according to claim 15 to express desired luster.

19. An ink jet recording method, comprising;

controlling the amount of a white ink applied to the ink jet recording medium according to claim 16 to express desired luster.

20. An ink jet recording method, comprising;

controlling the amount of a white ink applied to the ink jet recording medium according to claim 17 to express desired luster.

* * * * *